United States Patent [19]

Brückner et al.

[11] Patent Number: 4,738,224

[45] Date of Patent: Apr. 19, 1988

[54] WASTE HEAT STEAM GENERATOR

[76] Inventors: Hermann Brückner, Boggasse 3, 8521 Uttenreuth; Winfried Ganzer, Adalbert-Stifter Str. 10, 8520 Erlangen, both of Fed. Rep. of Germany

[21] Appl. No.: 855,753

[22] Filed: Apr. 24, 1986

[30] Foreign Application Priority Data

Apr. 26, 1985 [DE] Fed. Rep. of Germany ..... 3515174

[51] Int. Cl.[4] ..... F22D 1/00

[52] U.S. Cl. ..... 122/7 R; 122/421; 122/468

[58] Field of Search ..... 110/216, 233, 234; 122/7 R, 20 B, 420, 421, 460, 467, 468, 470, 483, 485

[56] References Cited

U.S. PATENT DOCUMENTS

| | | | |
|---|---|---|---|
| 2,020,686 | 11/1935 | Kaiser | 122/468 X |
| 2,547,589 | 4/1951 | Marshall | 122/7 R |
| 3,754,533 | 8/1973 | Franzmann et al. | 122/510 |
| 4,286,528 | 9/1981 | Willard | 110/216 X |
| 4,395,268 | 7/1983 | Zabelka | 122/7 R X |
| 4,493,291 | 1/1985 | Zabelka | 122/7 R |

FOREIGN PATENT DOCUMENTS

| | | |
|---|---|---|
| 0048326 | 3/1982 | European Pat. Off. . |
| 3248096 | 7/1984 | Fed. Rep. of Germany . |
| 8302592 | 8/1983 | France . |
| 8400411 | 2/1984 | PCT Int'l Appl. . |
| 200146 | 3/1939 | Switzerland . |
| 349345 | 5/1931 | United Kingdom . |
| 653540 | 5/1951 | United Kingdom . |
| 772991 | 4/1957 | United Kingdom . |
| 2068095 | 8/1981 | United Kingdom . |
| 2115129 | 9/1983 | United Kingdom . |

OTHER PUBLICATIONS

Gericke, "Abhitzedampf-Erzeugersysteme", Brennstoff-Warmekraft 35, No.°12, Dec. 1983, p. 499-504.

Gericke, "Abhitzedampf-Erzeugersysteme, -Brennstoff-Warmekraft 35, No. 11, Nov. 1983, p. 466-470.

*Primary Examiner*—Steven E. Warner

*Attorney, Agent, or Firm*—Herbert L. Lerner; Laurence A. Greenberg

[57] ABSTRACT

Waste heat steam generator for hot, dust-loaded gases under overpressure, with a gas feedline, with a gas exhaust line as well as with heat exchanger elements through which a coolant flows. The gas feedline is conducted inside a gas exhaust line, which opens from above into heat exchanger space which is concentrically arranged in a pressure vessel. The heat exchanger space is open at the lower end and in it the heat exchanger elements are supported. The space between the containment walls of the heat exchanger space and the pressure vessel wall at the upper end of the pressure vessel is connected to the gas exhaust line. The pressure vessel bottom in the form of a funnel is connected to an ash removal device. The containment walls of the heat exchanger space are provided with heat exchanger tubes.

12 Claims, 1 Drawing Sheet

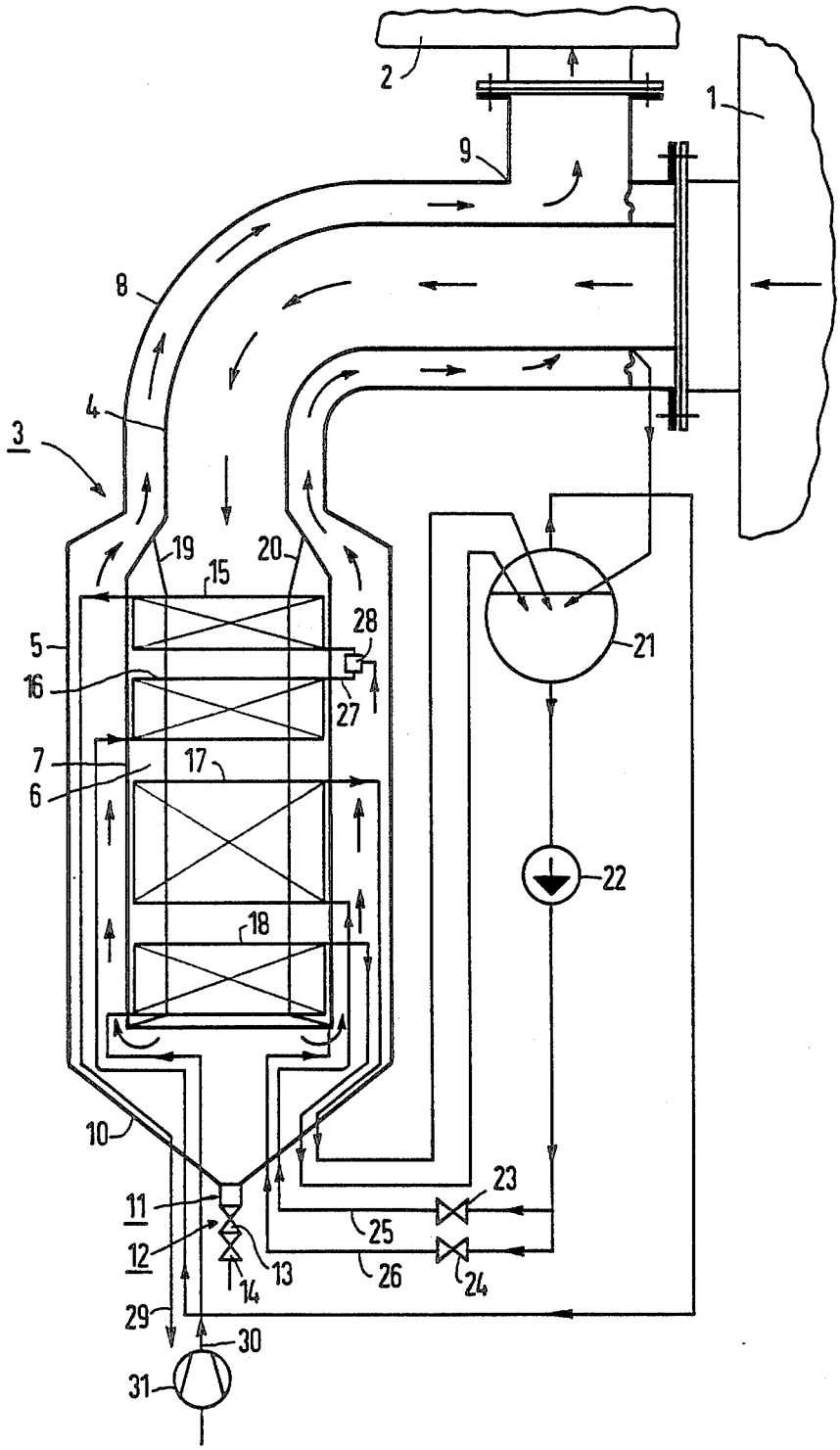
1
2
3
4
5
6
7
8
9
10
11
12
13
14
15
16
17
18
19
20
21
22
23
24
25
26
27
28
29
30
31

WASTE HEAT STEAM GENERATOR

BACKGROUND OF THE INVENTION

1. Field of the Invention

The invention relates to a waste heat steam generator for hot, dust-loaded gases under overpressure with a gas inlet line, a gas outlet line as well as with heat exchanger elements through which a cooling medium flows.

2. Description of the Prior Art

Waste heat steam generators are known. They are used particularly in gas and steam turbine power generating stations. They serve to utilize the heat content of the hot gases of the gas turbine for generating additional live steam. They consist generally of a cylindrical or rectangular flue-like structure in which the hot waste gases flow from the bottom up successively through the heat exchanger tubes of the convection heating surfaces of the end superheaters, intermediate superheaters, evaporators and economizers.

Such waste heat steam generators are also utilized behind reduction plants and in chemical processes for the recuperation of heat. In waste heat steam geneators which are arranged after combustion installations it is also known to have the combustion gases flow from the top down into the waste heat boiler and for this purpose the heat exchanger heating surfaces are arranged in the reverse order (see Bennstoff-Wärmekraft 35, 1983, No. 11, Pages 465 to 470 as well as No. 12, Pages 499 to 504).

In the heat recovery of the exhaust gases of pressurized coal gasification plants, additional problems arise in that high gas pressure as well as heavy dust loading and aggressivity of the gases must be added to the high gas temperature. Regarding the heat recovery in such plants, it is known to pre-cool the hot exhaust gases in a first pressure vessel equipped with heat exchanger heating surfaces, then to feed them into a following cyclone for dust removal and to cool them further in a second pressure vessel (British Patent Application No. 2,115,129=DE-OS 33 05 032).

British Pat. No. 653 540 discloses a heat exchanger in which the hot gas feeding line is arranged concentrically with the gas exhaust line. However, it is a peculiarity of this steam generator that it can be used only for dust-free gases because with dust laden gases, the lower spherical surface would become clogged up and the further flow of gas would be blocked.

SUMMARY OF THE INVENTION

It is an object of the invention to provide a steam generator for treatment of hot, dust-loaded gases under pressure, which operates with high efficiency, can be manufactured inexpensively and requires little space.

With foregoing and other objects in view, there is provided in accordance with the invention a waste heat steam generator for the extraction of heat from hot, dust laden gases under pressure, the generation of steam from the extracted heat and the separation of dust from the dust laden gases, comprising: a gas feedline for conducting hot, dust laden gases under pressure inside a gas exhaust line formed by the wall of the gas feedline and an outer spaced wall around the gas feedline, a pressure vessel with a heat exchanger space concentrically arranged in the pressure vessel, a plurality of heat exchange elements disposed in the heat exchanger space, containment walls with heat exchanger tubes and open at the bottom surrounding the heat exchange space and spaced from the pressure vessel wall, said gas feedline for conducting hot, dust laden gases opening from above into the heat exchanger space for discharge therein downwardly of the hot, dust laden gases in contact with the heat exchange elements with passage of the gases through the open bottom of the containment walls and reversal of flow of the gases upward through the space between the containment walls and the pressure vessel wall, said pressure vessel wall at the upper end of the pressure vessel connected to said outer spaced wall around the gas feedline for continued discharge of the cooled exhaust gases through the gas exhaust line, a funnel-shaped pressure vessel bottom connected to the pressure vessel wall for collecting dust precipitated from the dust laden gases, and a dust removal device for removing dust connected to the funnel-shaped bottom. Other features which are considered as characteristic for the invention are set forth in the appended claims.

Although the invention is illustrated and described herein as embodied in a waste heat steam generator, it is nevertheless not intended to be limited to the details shown, since various modifications may be made therein without departing from the spirit of the invention and within the scope and range of equivalents of the claims.

BRIEF DESCRIPTION OF THE DRAWING

The invention, however, together with additional objects and advantages thereof will be best understood from the following description when read in connection with the accompanying drawing which shows a schematic view of a waste heat steam generator according to the invention which is connected to a coal gasifier.

DESCRIPTION OF THE PREFERRED EMBODIMENTS

The invention relates to a waste heat steam generator for hot, dust-laden gases under high pressure. In such waste heat steam generators, the problem arises to make components which are in contact with the very hot gases under high pressure from becoming overstressed. To this end, the invention provides that the gas feedline carrying the hot, high pressure gases opens from above into a heat exchanger space. The latter arranged concentrically in a pressure vessel, is open at the lower end and in it heat exchanger elements are supported. The space between the containment walls of the heat exchanger space and the pressure vessel wall is connected at the upper end of the pressure vessel to a gas exhaust line. In addition, the pressure vessel bottom is desirably in the form of a funnel to which is connected an ash removal device. A waste heat steam generator according to the invention is particularly well suited for use behind charged coal gasifiers.

Due to the arrangement of the so-called heat exchanger space containing the heat exchanger elements in the interior of a pressure vessel the outer walls of which are flushed by the cooled-off gas, the full gas pressure can be taken up by the cooler outer walls of the pressure vessel. In this manner, the containment walls subjected to the hot gas stream, of the heat exchanger space need to take up only the pressure difference between the inflowing hot gas and the outflowing cooled-off gas. This pressure difference is in the order of magnitude of several meters water column and is substantially determined by the flow resistance offered to the gas stream by the heat exchanger elements. This arrangement also achieves the desirable condition that the outer wall of the pressure vessel of the waste heat steam generator need be heat-insulated only against a temperature which is between approximately 100° and 250° C. Further, the cost for heat insulation of the pressure vessel is reduced and the heat loss can be reduced distinctly. Also, connecting the gas feedline to the upper end of a heat exchanger space open toward the bottom is less prone to fouling by the entrained dust particles.

Due to the design of the heat exchanger open at the bottom and the forced reversal of the hot gases by 180° at the lower end of the heat exchanger space, a particularly intensive separation of the carried-along dust particles from the gas which has been largely cooled of in the meantime takes place in conjunction with the gas output line connected to the other end of the pressure vessel by the action of gravity and the centrifugal forces aiding the latter. These separated dust particles fall by gravity into the depression of the pressure vessel bottom. If the pressure vessel bottom is funnel-shaped, the ash and dust particles collecting at the bottom can be removed via an ash removal device connected there.

It is particularly advantageous to arrange the gas feedline inside the gas discharge line. Also, in this case, the gas feedline which is thermally highly stressed can be relieved to a large degree of pressure stresses and at the same time, less heat insulation is required and the heat loss can be reduced because of the substantially lower temperature of the gas discharge line.

The service life of the containment walls as well as of the gas feedline can be increased substantially if the latter support the heat exchanger tubes in an advantageous further embodiment of the invention.

Further details of the invention will be explained with the aid of an embodiment example shown in the drawing.

The drawing shows a waste heat steam generator 3 which is connected between a conventional coal gasifier 1 and a conventional gas purifier 2. The gas feedline 4 coming from the coal gasifier opens from above toward the bottom centrally into a heat exchanger space 6 arranged in a pressure vessel 5. This heat exchanger space is open at the bottom and leads there into the pressure vessel 5. The space between the containment walls 7 of the heat exchanger space 6 and the outer walls of the pressure vessel 5 is connected in turn at the upper end of the pressure vessel to a pressure-proof gas exhaust line surrounding the gas feedline 4. This gas exhaust line formed by inner line 4 and surrounding line 8 is lead via a branch 9 to the gas purification plant 2 in the vicinity immediately ahead of the coal gasifier. The bottom 10 of the pressure vessel 5 is funnel-shaped and carries at its lowest point an ash removal device 11. The latter consists of an ash lock 12 with two series-connected valves 13, 14.

The heat exchanger space 6 contains, reading from the top down, two superheater heating surfaces 15 and 16, an evaporator heating surface 17 as well as, completely at the lower end of the heat exchanger space 6, an economizer heating surface 18.

The containment walls of the heat exchanger space 6 are designed as fin-type tube walls. The superheater, evaporator and economizer heating surfaces are suspended in the heat exchanger space 6 from support tubes 19, 20 (only two are shown) which are brought through the above-mentioned heat exchanger surfaces and through which circulation water flows. The support tubes 19, 20 are in the embodiment example connected parallel to the fin tubes of the containment walls of the heat exchanger space 6. Also the interior wall of the gas feedline through which the hot gases from coal gasifier flow, is in the form of a fin-tube wall. Its fin tubes are connected in series with those of the containment wall 7. The heat exchanger tubes of the economizer heating surfaces 18, the evaporator heating surfaces 17 and the fin tubes of the gas feed line are connected on the output side to a common water/steam separating vessel 21. The heated water in separating vessel 21 is transported by a circulating pump 22 into two lines 25 and 26 which can be acted upon independently of each other by means of control valves 23, 24. The water pumped through line 25 is transported into the evaporator heating surfaces 17. The water flowing through pipe 26 goes into the fin tubes of the containment walls 7 of the heat exchanger space 6 and the support tubes 19, 20 connected parallel to the walls 7.

Water of the circulation leg 26 leaving the heat exchanger tubes of the containment wall 7 and support tubes 19, 20 is conducted into the heat exchanger tubes of the gas feedline. The steam side of the water-steam separating vessel 21 is connected to the superheater heating surfaces 15, 16 which are connected to each other in series by a steam line 27. An injection cooler 28 for controlling the temperature of the live steam leaving the last superheater 15 via the live steam line 29 is built into the steam line 27 connecting the two superheater heating surfaces to each other. A feedwater line 30 coming from the condenser, not shown here, is connected to the input of the economizer 18 via a feedwater pump 31.

In operation, hot, dust-containing raw gas generated in the coal gasifier 1, flows via the gas inlet line from above into the heat exchanger space 6 of the waste heat steam generator 3. This gas has a temperature of about 1000° to 1400° C. and, due to the charging of the coal gasifier 1, a pressure from 10 to 60 bar. The raw gas from the coal gasifier is heavily loaded with dust particles. The dust laden raw gas flows in the heat exchanger space 6 wherein it first contacts the two superheater surfaces 15, 16, then passes in contact with the evaporator heating surfaces 17 and finally, in contact with the economizer heating surfaces 18. The raw gas by then largely cooled down, flows into the pressure vessel 5 at the lower open end of the heat exchanger space 6, and is deflected 180° there. The cooled down raw gas flows upward again outside the containment walls 7 of the heat exchanger space 6, but within the pressure vessel 5. In the process, the dust particles are flung into the ash funnel in the bottom 10 of the pressure vessel through the deflection of 180° as well as, aided by the force of gravity. The ash can be removed there via a known ash removal device 11. The gas which is largely freed of ash and is cooled down to 150° to 400° C. now flows upward in the pressure vessel 5. The gas continues its flow via the gas exhaust line enclosing the gas feedline until near to the coal gasifier 1 where in the gas exhaust line there is the branch 9 through which the gas flows to the gas purifier 2. The gas on this return path, cools the gas feedline and supports it by its pressure, so that the gas feedline need take up only the difference in pressure between the gas stream flowing into the waste heat steam generator 3 and the gas stream leaving the latter. This not only has the advantage that the thermally heavily stressed gas feedline is largely pressure-relieved but also that the heat losses are reduced and the insulation of this coaxial gas feed and gas removal line as well as of the waste heat steam generator 3 is greatly simplified because their outer walls which get only to a temperature of 200° C. can be insulated thermally better.

Fresh feedwater is fed by the feedwater pump 31 through the feedwater line 30 into the economizer heating surfaces 18. The warmed-up feedwater leaving the economizer heating surfaces 18 is fed into the water/steam separating vessel 21. Part of the water in vessel 21 is directed by the recirculating pump 22 into the evaporator heating surfaces 17 and is returned from there, mixed with steam, into the water/steam separating vessel 21. Another part of the heated-up feedwater in separating vessel 21 is also transported by pump 22 into the heat exchanger tubes of the containment walls 7 of the heat exchanger space 6 and to the gas feedline. The feedwater mixed with steam is from the evaporator heating surfaces as well as from the gas feedline transported into the water/steam separator vessel 21. The feedwater separates from steam in separator vessel 21 and the separated feedwater is fed again to the separation pump 22. The steam from the water-steam separator vessel 21 is conducted into the two series-connected superheater heating surfaces 15, 16. The steam from the second superheater heating surface 15, flows directly to the consumer via the live steam line 29. The quality of the live steam can be controlled further by the injection cooler 28 connected into the steam line 27 between the two superheater heating surfaces 15 and 16.

There is claimed:

1. Waste heat steam generator for the extraction of heat from hot, dust laden gases under pressure, the generation of steam from the extracted heat and the separation of dust from the dust laden gases, comprising: a gas feedline for conducting hot, dust laden gases under pressure inside a gas exhaust line formed by the wall of the gas feedline and an outer spaced wall around the gas feedline, a pressure vessel with a heat exchanger space concentrically arranged in the pressure vessel, a plurality of heat exchange elements disposed in the heat exchanger space, containment walls with heat exchanger tubes and open at the bottom surrounding the heat exchange space and spaced from the pressure vessel wall, said gas feedline for conducting hot, dust laden gases opening from above into the heat exchanger space for discharge therein downwardly of the hot, dust laden gases in contact with the heat exchange elements with passage of the gases through the open bottom of the containment walls and reversal of flow of the gases upward through the space between the containment walls and the pressure vessel wall, said pressure vessel wall of the upper end of the pressure vessel connected to said outer spaced wall around the gas feedline for continued discharge of the cooled exhaust gases through the gas exhaust line, a funnel-shaped pressure vessel bottom connected to the pressure vessel wall for collecting dust precipitated from the dust laden gases, and a dust removal device for removing dust connected to the funnel-shaped bottom, wherein heat exchange elements are connected as two parallel connected recirculation loops which can be regulated separately with one recirculation loop connected to evaporator heating surfaces in the heat exchanger space and the other recirculation loop connected to heat exchanger tubes of the containment walls, support tubes for the heat exchange elements and heat exchanger tubes of the gas feedline.

2. Waste heat steam generator according to claim 1, wherein the containment walls of the heat exchanger space are finned tube walls.

3. Waste heat steam generator according to claim 1, wherein the wall of the gas feedline is a fin tube wall.

4. Waste heat steam generator according to claim 1, wherein the gas feedline arranged concentrically in the gas exhaust line connects the heat exchanger space to a combustion chamber.

5. Waste heat steam generator according to claim 1, wherein individual heat exchangers of the heat exchanger space are connected as forced-circulation steam generators.

6. Waste heat steam generator according to claim 1, wherein both recirculation loops are connected to a single steam/water separating vessel.

7. Waste heat steam generator according to claim 1, wherein each recirculation loop has a separate control valve.

8. Waste heat steam generator according to claim 1, wherein each recirculating loop has a separate recirculation pump.

9. Waste heat steam generator according to claim 1, wherein the gas feedline arranged concentrically in the gas exhaust line connects the heat exchanger space to a coal gasifier.

10. Waste heat steam generator according to claim 9, wherein the gas exhaust line is connected to a gas purifier.

11. Waste heat steam generator according to claim 1, wherein water or steam is used as a cooling medium in the heat exchange elements.

12. Waste heat steam generator according to claim 11, wherein individual heat exchangers of the heat exchanger space are connected as forced-circulation steam generators.

* * * * *

UNITED STATES PATENT OFFICE

CERTIFICATE OF CORRECTION

PATENT NO. : 4,738,224

DATED : April 19, 1988

INVENTOR(S) : Hermann Brückner et al.

It is certified that error appears in the above-identified patent and that said Letters Patent is hereby corrected as shown below:

In the Title Page, Item 73 should read "Siemens Aktiengesellschaft, Munich, Fed. Rep. of Germany".

Signed and Sealed this

Eighteenth Day of July, 1989

*Attest:*

DONALD J. QUIGG

*Attesting Officer*

*Commissioner of Patents and Trademarks*